US008079336B2

(12) United States Patent
Polt

(10) Patent No.: US 8,079,336 B2
(45) Date of Patent: Dec. 20, 2011

(54) COMPACT VALVE ACTUATION MECHANISM FOR BARREL INTERNAL COMBUSTION ENGINES

(75) Inventor: Anton Polt, Judendorf-Strassengel (AT)

(73) Assignee: Thomas Engine Company, LLC, Boulder, CO (US)

( * ) Notice: Subject to any disclaimer, the term of this patent is extended or adjusted under 35 U.S.C. 154(b) by 735 days.

(21) Appl. No.: 11/917,147

(22) PCT Filed: Jun. 23, 2006

(86) PCT No.: PCT/US2006/024591

§ 371 (c)(1),
(2), (4) Date: Jul. 14, 2008

(87) PCT Pub. No.: WO2007/002475

PCT Pub. Date: Jan. 4, 2007

(65) Prior Publication Data

US 2010/0199932 A1 Aug. 12, 2010

Related U.S. Application Data

(63) Continuation of application No. 11/472,718, filed on Jun. 22, 2006, now abandoned.

(60) Provisional application No. 60/693,497, filed on Jun. 23, 2005, provisional application No. 60/774,856, filed on Feb. 17, 2006.

(51) Int. Cl.
*F01L 1/18* (2006.01)

(52) U.S. Cl. ..... 123/90.39; 123/90.41; 123/90.44; 123/90.48

(58) Field of Classification Search ..... 123/90.39, 123/90.41, 90.44, 90.48
See application file for complete search history.

(56) References Cited

U.S. PATENT DOCUMENTS

| | | | |
|---|---|---|---|
| 1,147,313 | A | 7/1915 | Desort |
| 1,389,967 | A | 9/1921 | Murphy |
| 2,686,511 | A | 8/1954 | Platner |
| 3,169,514 | A | 2/1965 | Girodin |
| 5,442,971 | A | 8/1995 | Romanchev et al. |
| 6,899,065 | B2 | 5/2005 | Hauser |

FOREIGN PATENT DOCUMENTS

| | | | |
|---|---|---|---|
| EP | 0079750 | | 5/1983 |
| EP | 0453249 | | 10/1991 |
| FR | 2267446 | A1 | 11/1975 |
| JP | 11294182 | A | 10/1999 |

*Primary Examiner* — Ching Chang
(74) *Attorney, Agent, or Firm* — Gifford, Krass, Sprinkle, Anderson & Citkowski, P.C.; Douglas L. Wathen

(57) ABSTRACT

A multi-cylinder barrel internal combustion engine includes a valve actuation mechanism having generally L-shaped rockers for actuating valves in the engine. The rockers are arranged in pairs each pivotally coupled to a common rocker support. The pair of rockers actuate respective valves of an adjacent pair of cylinders in the engine.

26 Claims, 12 Drawing Sheets

COMPACT VALVE ACTUATION MECHANISM FOR BARREL INTERNAL COMBUSTION ENGINES

REFERENCE TO RELATED APPLICATIONS

This application is the U.S. national phase of PCT/US2006/024591, filed Jun. 23, 2006, which claims priority to U.S. patent application Ser. No. 11/472,718, filed Jun. 22, 2006, now abandoned, and U.S. Provisional Patent Application Ser. Nos. 60/693,497, filed Jun. 23, 2005 and 60/774,856, filed Feb. 17, 2006, the entire content of each application are incorporated herein by reference.

FIELD OF THE INVENTION

The invention relates to a valve arrangement for a barrel internal combustion engine. More particularly, the invention relates to a compact valve actuation mechanism for actuating the intake and exhaust valves of the valve arrangement.

BACKGROUND OF THE INVENTION

Internal combustion engines are widely used for driving a variety of vehicles and stationary equipment. Internal combustion engines come in a variety of configurations, which are typically aptly named for the particular orientation or arrangement of the reciprocating pistons and cylinders in the engines. One example of an internal combustion engine is a "V" type engine, in which the "V" refers to the arrangement of the cylinders in rows that are angled relative to each other to form a V shape. Another type of internal combustion engine that is most relevant to the invention is a barrel-type engine.

The barrel engine includes a plurality of cylinders and pistons arranged in the form of a "barrel" in which their axes are parallel to each other and typically arranged along a circle concentric with a central drive shaft. Power is transmitted from the reciprocating pistons to a cam plate via a roller or bearing interface. The cam plate has a generally sinusoidal shape, so that the axial reciprocal movement of the pistons causes rotational movement of the cam plate and drive shaft.

The barrel engine also typically includes a valve assembly for controlling the intake of fuel-air and exhaust of combustion products. The valve assembly is actuated by a valve actuation mechanism and timed for appropriate intake and exhaust during the intake, compression, power and exhaust strokes of the engine.

It remains desirable to provide an improved valve actuation mechanism for actuating the valves in the barrel engine.

BRIEF DESCRIPTION OF THE DRAWINGS

Advantages of the present invention will be readily appreciated as the same becomes better understood by reference to the following detailed description when considered in connection with the accompanying drawing, wherein.

SUMMARY OF THE INVENTION

Figure 1:
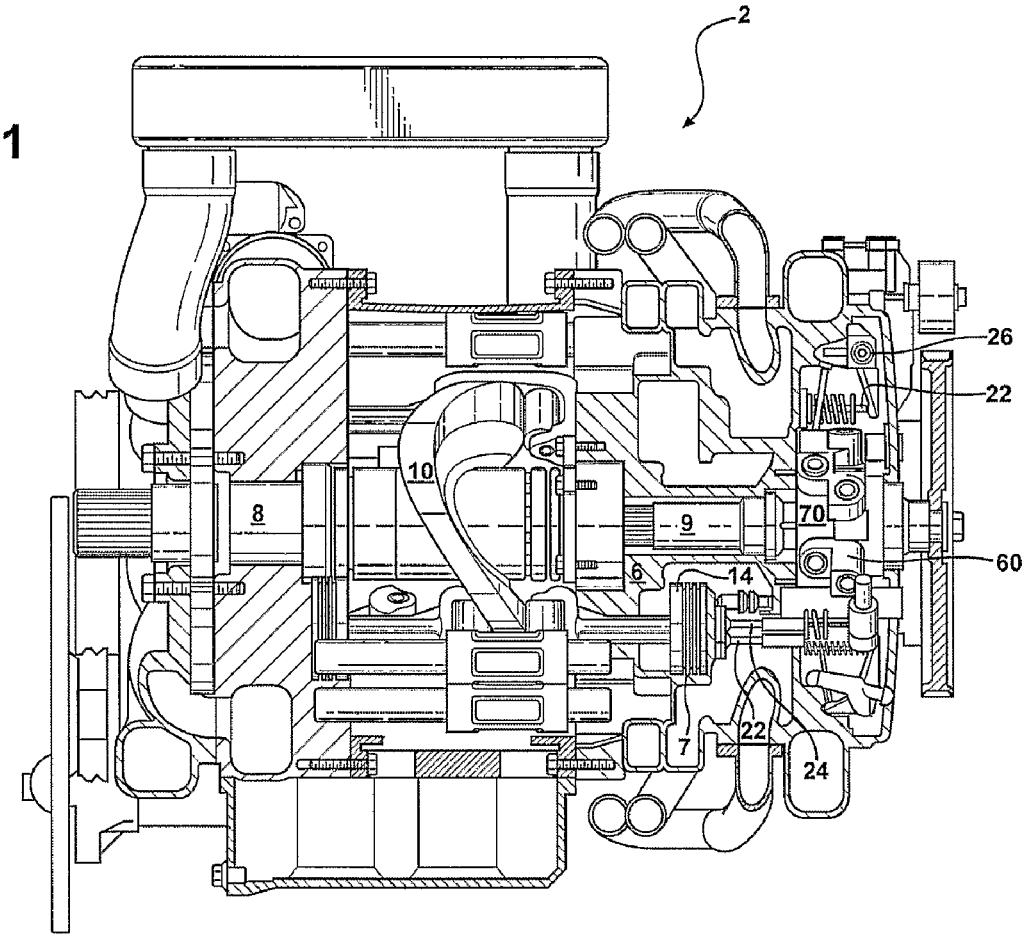
FIG. 1 is a side elevational view cutaway to illustrate the inside of a barrel internal combustion engine according to a first embodiment of the invention.

According to one aspect of the invention, a valve actuation mechanism is provided for a barrel internal combustion engine having a drive shaft, an undulating cam plate interconnected with the drive shaft for rotation therewith, and a plurality of cylinders radially spaced apart from the drive shaft. The valve actuation mechanism includes a plurality of tappets, a plurality of valves, a plurality of rockers for actuating the valves and a rocker support. The tappets are configured to engage a cam portion of a rotatable drive shaft so as to cause axial displacement of each tappet in response to rotation of the drive shaft. Each valve has a valve head and a valve stern extending from the valve head. The rockers are mechanically coupled to the tappets for actuating the valves in response to rotation of the drive shaft. The rocker support pivotally supports a pair of the rockers for movement about respective pivot axes. The rockers are configured to actuate respective valves of an adjacent pair of cylinders in the engine.

According to another aspect of the invention, a barrel internal combustion includes a longitudinally extending drive shaft, a plurality of cylinders, a plurality of valves, a pair of cam lobes, a plurality of tappets, a plurality of rockers and a rocker support. The drive shaft is rotatable about a center axis. The drive shaft includes a cam portion. Each cylinder has an axis generally parallel with the drive shaft. The valves control the flow of gases through the cylinders. The lobes extend radially outwardly from the cam portion for rotation therewith. The tappets are engaged with the cam lobes to cause radial displacement of each tappet relative to the center axis during rotation of the drive shaft about the center axis. Each rocker is moveable about a pivot for actuating the valves. The rocker support pivotally supports a pair of the rockers for movement about the respective pivots. The pair of the rockers actuate the valves of an adjacent pair of cylinders.

According to another aspect of the invention, a barrel internal combustion engine includes a drive shaft, a plurality of cylinders, a plurality of valves, a pair of cam lobes, a plurality of tappets, and a plurality of rockers. The drive shaft is rotatable about a center axis. The drive shaft includes a cam portion. Each cylinder has an axis generally parallel with the drive shaft. The valves control the flow of gases through the cylinders. The cam lobes extend radially outwardly from the cam portion for rotation therewith. The tappets are engaged with the cam lobes to cause radial displacement of each tappet relative to the center axis during rotation of the drive shaft about the center axis. Each rocker is moveable about a pivot for actuating the valves. Each rocker has a pair of arms extending outwardly from the pivot. One of the pair of arms is coupled to one of the valves and the other of the pair of arms is coupled to one of the tappets to cause actuation of the valve in response to the radial displacement of the tappet during rotation of the drive shaft. One of the pair of arms extends from the pivot toward the cylinders.

According to another aspect of the invention, a barrel internal combustion engine includes a drive shaft, a plurality of cylinders, a plurality of valves, a pair of cam lobes, a plurality of spark plugs, a plurality of tappets, a plurality of rockers, and a spark plug tube. The drive shaft is rotatable about a center axis. The drive shaft includes a cam portion. Each cylinder has an axis generally parallel with the drive shaft. The spark plugs ignite a charge in the cylinders. The valves control the flow of gases through the cylinders. The cam lobes extend radially outwardly from the cam portion for rotation therewith. The tappets are engaged with the cam lobes to cause radial displacement of each tappet relative to the center axis during rotation of the drive shaft about the center axis. Each rocker is moveable about a pivot for actuating the valves. Each rocker has a pair of arms extending outwardly from the pivot. One of the pair of arms is coupled to one of the valves and the other of the pair of arms is coupled to one of the tappets to cause actuation of the valve in response to the radial displacement of the tappet during rotation of the drive shaft. A pair of the rockers are configured to actuate a pair of the valves of one of the cylinders. The spark plug tube extends between the arms of the pair of the rockers to define a path for access to one of the spark plugs.

DETAILED DESCRIPTION OF THE INVENTION

The present invention provides an improved valve actuation mechanism for a barrel-type internal combustion engine. Described in greater detail below, the valve actuation mechanism utilizes a pair of L-shaped rockers pivotaly coupled to a common rocker support for actuating respective valves of an adjacent pair of cylinders in the engine.

Referring to FIG. 1, a barrel internal combustion engine according to one embodiment of the invention is generally indicated at 2. The engine 2 includes an engine block 4 having a plurality of cylinders 6. A central drive shaft 8 is rotatably supported in a bore formed in the engine block for rotation about a fixed rotational axis. Each of the cylinders 6 extends longitudinally along an axis that is generally parallel with the rotational axis of the drive shaft 8. The cylinders 6 are radially spaced apart from the drive shaft 8 and arranged in a circular or "barrel" shape manner relative to the drive shaft 8. An undulating cam plate 10 is fixedly secured to the drive shaft 8 for rotation therewith about the rotational axis. A plurality of pistons 7 are each slidably supported in one of the cylinders 6 for reciprocating movement along the cylinder axis. The pistons 7 are operatively coupled to the cam plate 10 to cause rotation of the drive shaft 8 about the rotational axis in response to the reciprocating movement of the pistons 7 within the cylinders 6.

The engine 2 also includes a plurality of valves 22, 24 for controlling the flow of gases through the cylinders 6. In this embodiment, the engine 2 is a four-stroke engine having an intake valve 22 and an exhaust 24 valve provided for each cylinder 6. Each valve 22, 24 includes a head and a stem extending outwardly from the head. The valves 22, 24 are driven by the valve actuation mechanism, which in turn is driven by a cam portion 9 of the drive shaft 8. In this version, the cam portion 9 is a separate component and subsequently assembled to the drive shaft 8 for rotation therewith about the rotational axis. Optionally, the cam portion 9 may be integrally formed with the drive shaft 8.

Referring to FIGS. 2-6, a pair of cam lobes 14, 16 extends radially outwardly from the cam portion 9 for actuating the valves 22, 24 during rotation of the drive shaft 8. One of the pair of cam lobes, an upper lobe 14, actuates the intake valves 22. The other of the pair of cam lobes, a lower lobe 16, actuates the exhaust valves 24. Each lobe 14, 16 extends circumferentially around the cam portion 9 of the drive shaft 8. The lobes 14, 16 are axially spaced apart along the drive shaft 8. It should be appreciated by those having ordinary skill in the art that the function of the upper 14 and lower 16 lobes may be interchanged, i.e. the upper lobe 14 may be configured to actuate exhaust valves, while the lower lobe 16 may by configured to actuate intake valves.

The actuating mechanism includes a plurality of lifters or tappets 18, 20, which correspond in number to the plurality of valves 22, 24. Each tappet 18, 20 has a generally cylindrical shape extending along a longitudinal axis and is supported in a bore that extends through a tappet carrier 60. Each tappet 18, 20 is slidable along its longitudinal axis within the bore. In this embodiment, the longitudinal axis of each tappet 18, 20 is generally radially aligned with respect to the rotational axis of the drive shaft 8. A roller bearing 19, 21 is pivotally coupled to an inner end of each tappet 18, 20. The bearing 19, 21 is rollingly engaged with one of the lobes 14, 16, so as to cause reciprocating movement of the tappet 18, 20 along its longitudinal axis during rotation of the drive shaft 8. An outer end of each tappets 18, 20 is recessed to receive an end of a pushrod 30, 32 therein. Alternatively, the tappets may be provided in the form of bucket tappets.

In the illustrated embodiment, the tappets 18 and 20 are roller tappets that also include hydraulic lash adjusters. It should be appreciated that conventional mechanical lash adjusters may be utilized instead of hydraulic lash adjusters. Alternatively, the lash adjustment may be provided at other locations, such as lash adjusters provided on top of each valve stem.

The tappets 18, 20 are arranged in upper and lower sets that are axially spaced apart with respect to the drive shaft 8. The upper set of tappets 18 is engaged with the upper lobe 14, while the lower set of tappets 20 is engaged with the lower lobe 16. The tappets 18, 20 are also positioned in the carrier 60 so that the tappets 18 actuating the intake valves 22 are offset axially (FIG. 6) and rotationally (FIG. 7) with respect to the tappets 20 actuating the exhaust valves 24. Arranging the tappets 18, 20 in this manner minimizes the volume of space occupied by the tappets 18, 20 and the size of the tappet carrier 60. Alternatively, the tappets 18, 20 may be more closely aligned rotationally, though this will typically increase the axial spacing and the size of the carrier 60.

Figure 2:
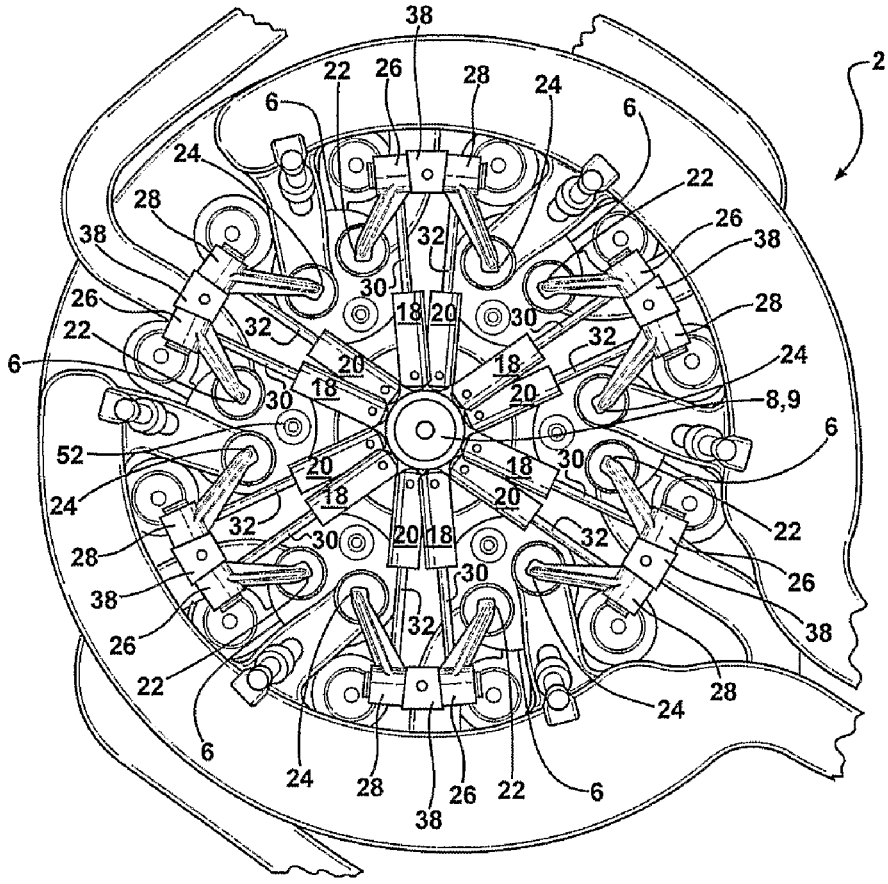
FIG. 2 is a top elevational view of the barrel engine of FIG. 1 illustrating the valve actuation mechanism according to the first embodiment of the invention.
Figure 3:
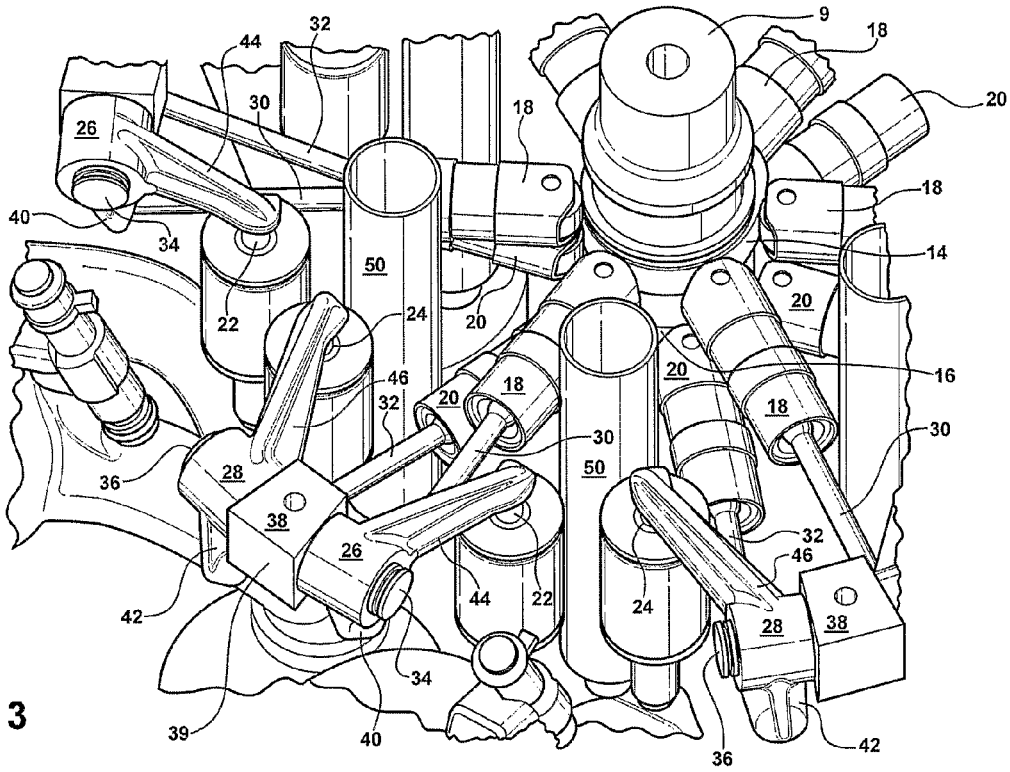
FIG. 3 is a partial top perspective view of the barrel engine according to the first embodiment of the invention.
Figure 4:
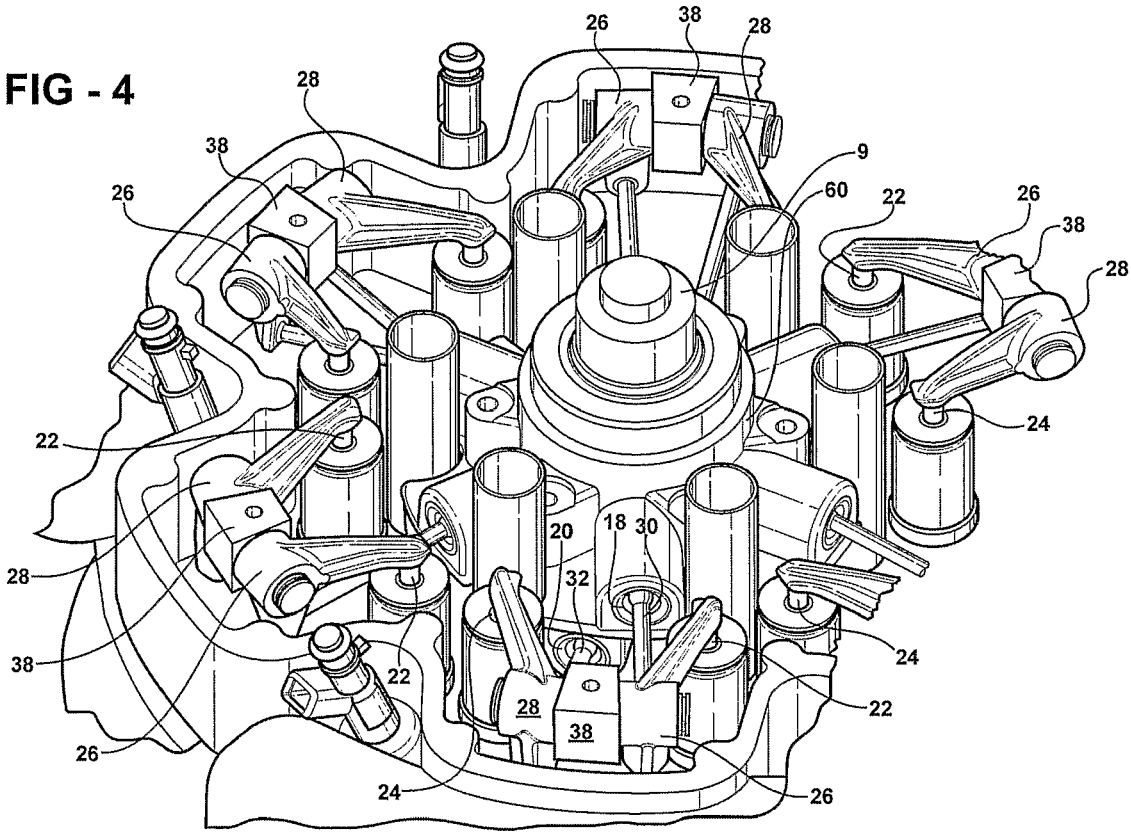
FIG. 4 is a partial top perspective view of the barrel engine according to the first embodiment of the invention shown with a tappet carrier.
Figure 5:
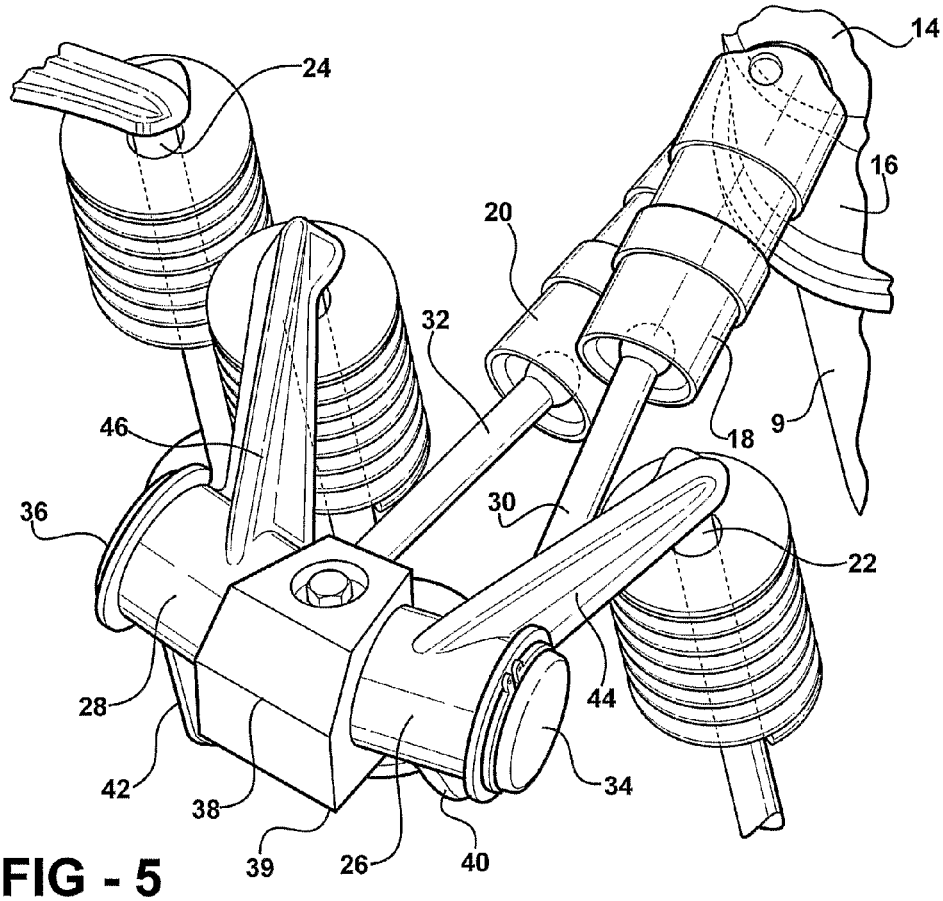
FIG. 5 is an enlarged top perspective view of the valve actuation mechanism according to the first embodiment of the invention.
Figure 6:
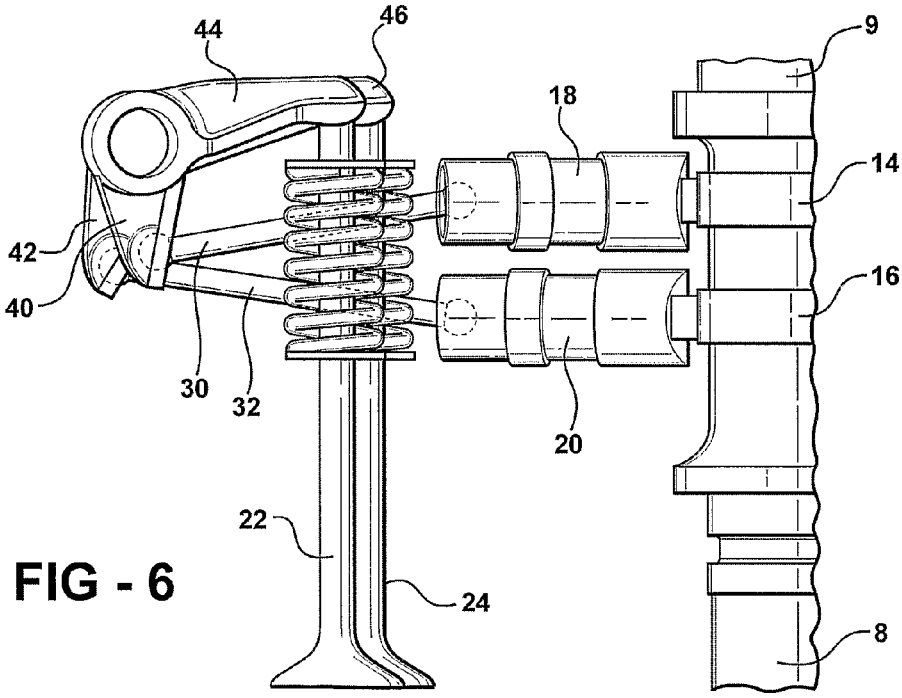
FIG. 6 is a side elevational view of the valve actuation mechanism according to the first embodiment of the invention.

A plurality of rocker supports 38 are fixedly secured to the engine block. the supports 38 may be secured to the engine block utilizing a bolt. If a single bolt is used, a dowel pin may be used to prevent rotation of the support 38 about the bolt. Alternatively, more than one bolt may be used to secure the support 38 to the engine block. Each rocker support 38 includes a main body 39 and a pair of pivot pins 34, 36 extending from opposite sides thereof. As best shown in FIG. 2, the pivot pins 34, 36 are spaced radially outwardly relative to the cylinders 12, and the rocker supports 38 are arranged generally in a circle concentric with the drive shaft 8.

A pair of generally L-shaped rockers 26, 28 is pivotally coupled to the pair of pivot pins 34, 36. Each rocker 26, 28 includes a first arm 40, 42 extending from the pivot pin 34, 36 toward the cylinders. Each rocker 26, 28 also includes a second arm 44, 46 extending generally toward the cam portion 9 of the drive shaft 8. A pushrod 30, 32 extends between each tappet 18, 20 and the first arm 40, 42 of each rocker 26, 28. The second arm 44, 46 of each rocker 26, 28 is coupled to a valve stem of one of the valves 22, 24. The rockers 26, 28 are arranged in pairs for actuating respective valves 22, 24 of an adjacent pair of cylinders 6. Further, the tappets 18, 20 and pushrods 30, 32 corresponding to each pair of adjacent rockers 26, 28 are also arranged adjacent to one another in pairs. The adjacent pairs of tappets 18, 20 and pushrods 30, 32 are disposed generally between adjacent cylinders 6, rather than extending over any one cylinder 6. This provides numerous packaging benefits. Additionally, the pair of rockers 26, 28 are, in this embodiment, supported on a common rocker support 38. Alternatively, each rocker 26, 28 of each pair may be supported on its own individual support.

Figure 7:
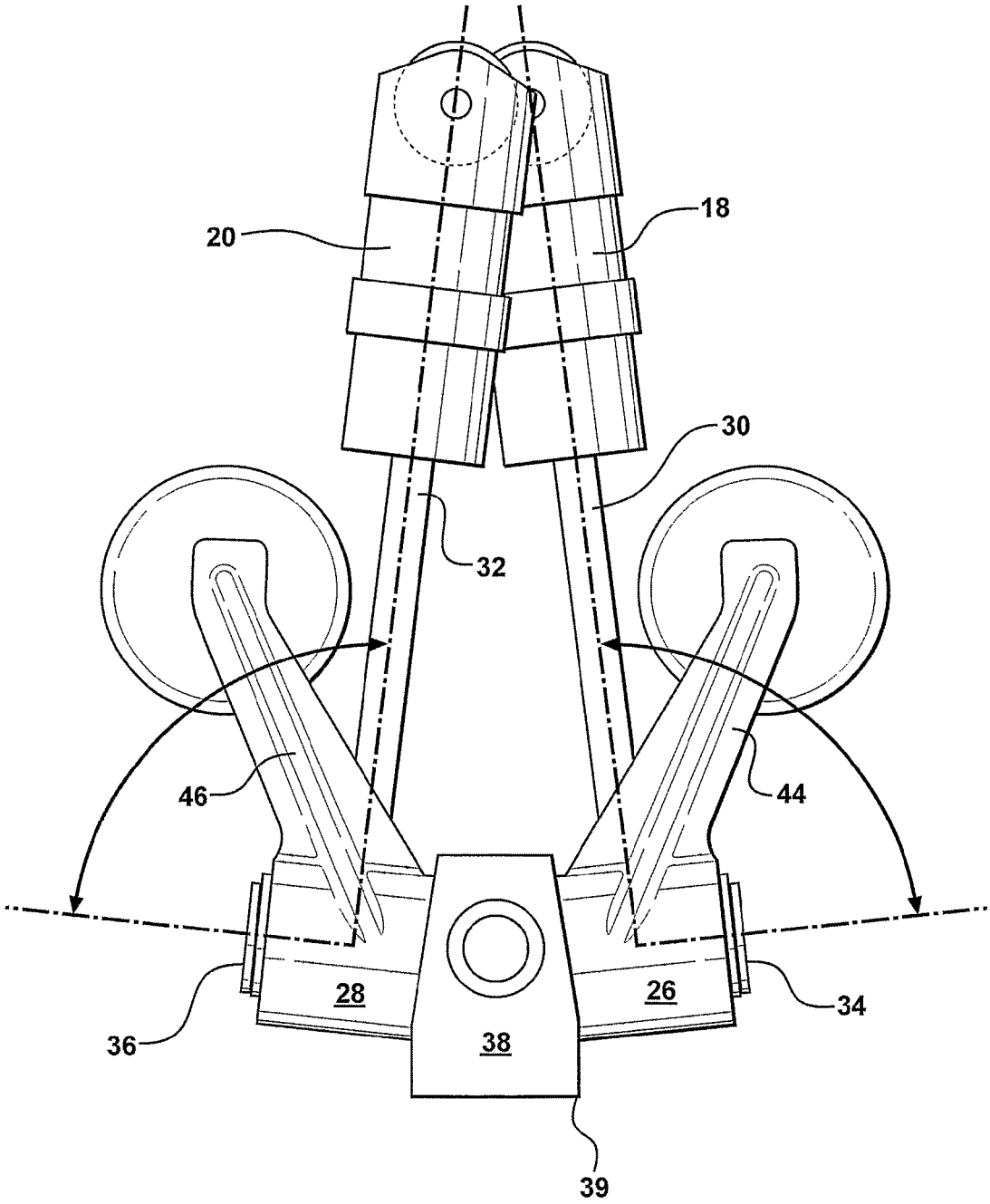
FIG. 7 is a top elevational view of the valve actuation mechanism according to the first embodiment of the invention.
Figure 8:
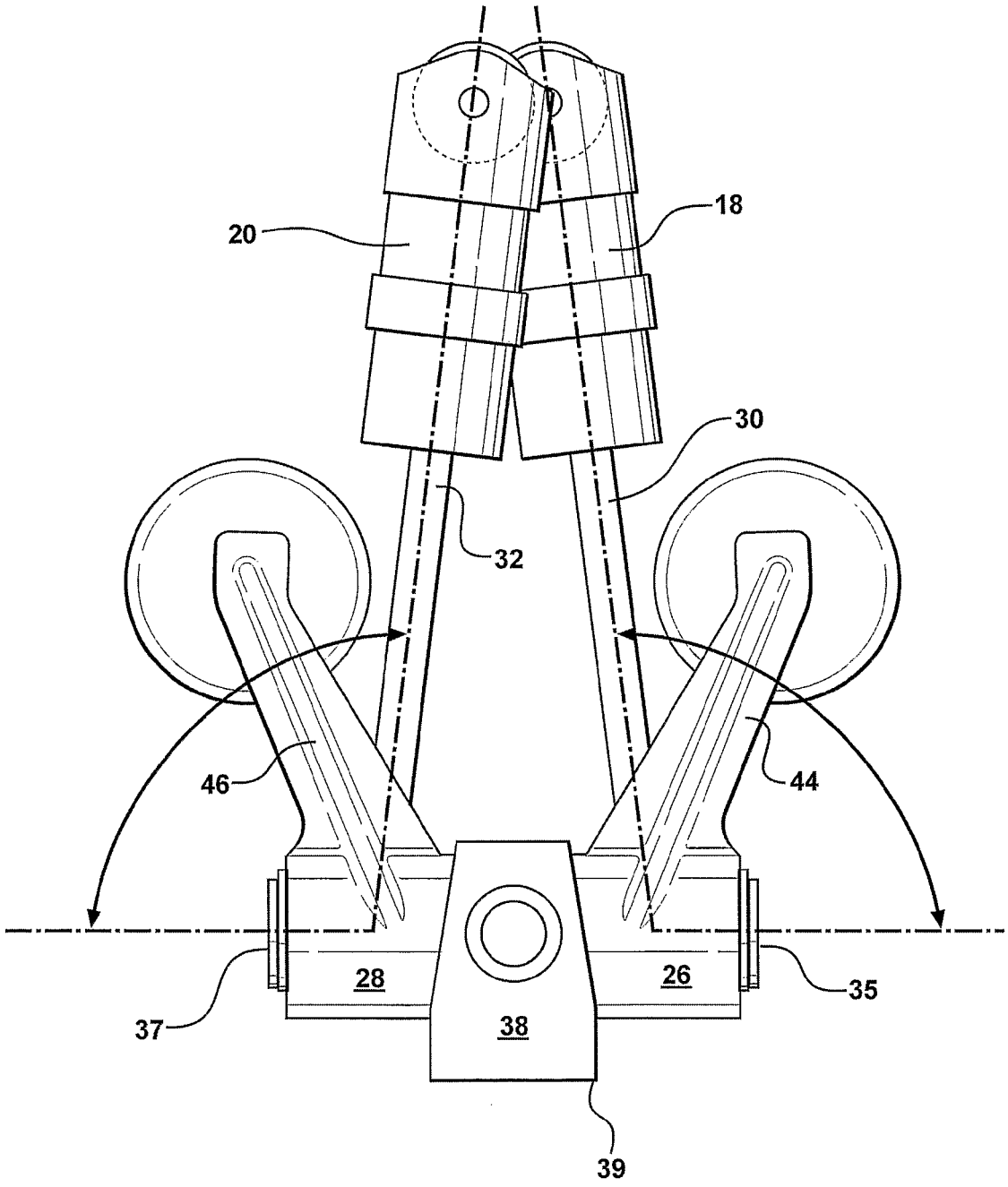
FIG. 8 is a top elevational view of the valve actuation mechanism according to a second embodiment of the invention.

As shown in FIG. 7, the pivot pins 34, 36 are not coaxial relative to each other. Specifically, the pivot pins 34, 36 are positioned generally orthogonally with respect to the pushrods 30, 32 to minimize axial loading between the rockers 26, 28 and the main body 39 of the rocker support 38. As shown in FIG. 8, in a second embodiment of the invention, the pivot pins 35, 37 are positioned coaxially relative to each other to simplify the assembly of the rocker support 38 and pivot pins 35, 37.

Figure 9:
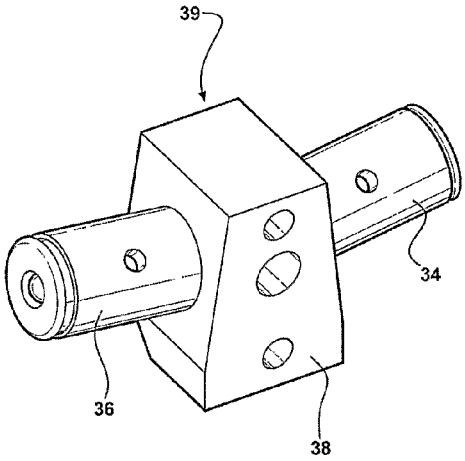
FIG. 9 is a bottom perspective view of a rocker support according to the first embodiment of the invention.
Figure 10:
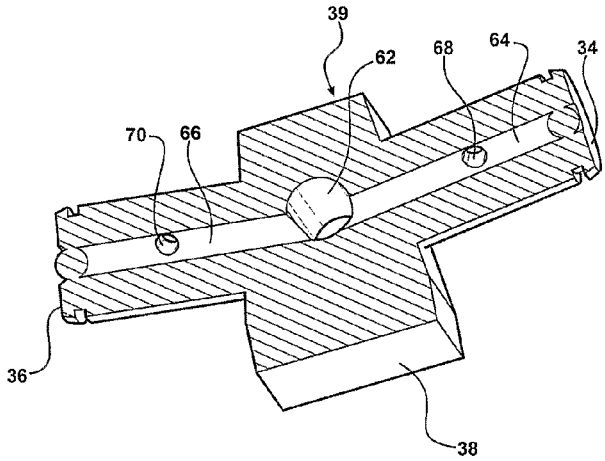
FIG. 10 is a bottom perspective view of a rocker support cutaway to illustrate oil paths that extend through the support according to the first embodiment of the invention.

Referring to FIGS. 9 and 10, oil paths 64, 66 may be formed in the rocker support 38 for lubricating the interface between the rockers 26, 28 and the outer surface of the pivot pins 34, 36. Pressurized oil is fed through a main conduit 62 that extends through the main body 39 of the support 38. The main conduit 62 is in fluid communication with the oil paths 64, 66. Oil is delivered to the interface between the rockers 26, 28 and the pivot pins 34, 36 through outlets 68, 70 that extend between the oil paths 64, 66 and the outer surface of the pivot pins 34, 36. Alternatively or additionally, pressurized oil may be provided from the tappets 18 and 20 through hollow pushrods 30 and 32. The rocker arms may have a passage that passes oil from the contact with the pushrods to the rocker shafts 34 and 36. Alternatively, the flow of oil may be reversed with oil flowing from the supply in the rocker shaft assembly. It should be appreciated that the oil paths and outlets as described above may be implemented in either of the rocker supports and pivot pins arrangements shown in FIGS. 7 and 10.

During operation of the engine, the cam portion 9 and the cam lobes 14, 16 rotate together with the drive shaft 8 about the rotational axis. The rotation of the lobes 14, 16 causes reciprocating displacement of the tappets 18, 20 along their respective longitudinal axes. The reciprocating axial movement of the tappets 18, 20 is transferred by the rods 30, 32 to the rockers 26, 28, thereby causing reciprocating rotational movement of the rockers 26, 28 about their respective pivot pins 34, 36. The reciprocating rotational movement of the rockers 26, 28, in turn, actuates the valves 22, 24.

The timing of the actuation of the intake 22 and exhaust 24 valves is generally determined by the rotational offset of the eccentricity of one lobe 14 relative to the other lobe 16, one or both lobes 14, 16 relative to the drive shaft 8 and/or cam plate 10. It should be appreciated by those skilled in the art that the timing of the actuation of the valves 22, 24 can be changed by utilizing a conventional earn phasing mechanism known by those skilled in the art. The cam phasing mechanism allows adjustment of the rotational position of one lobe 12 relative to the other lobe 14.

Figure 11:
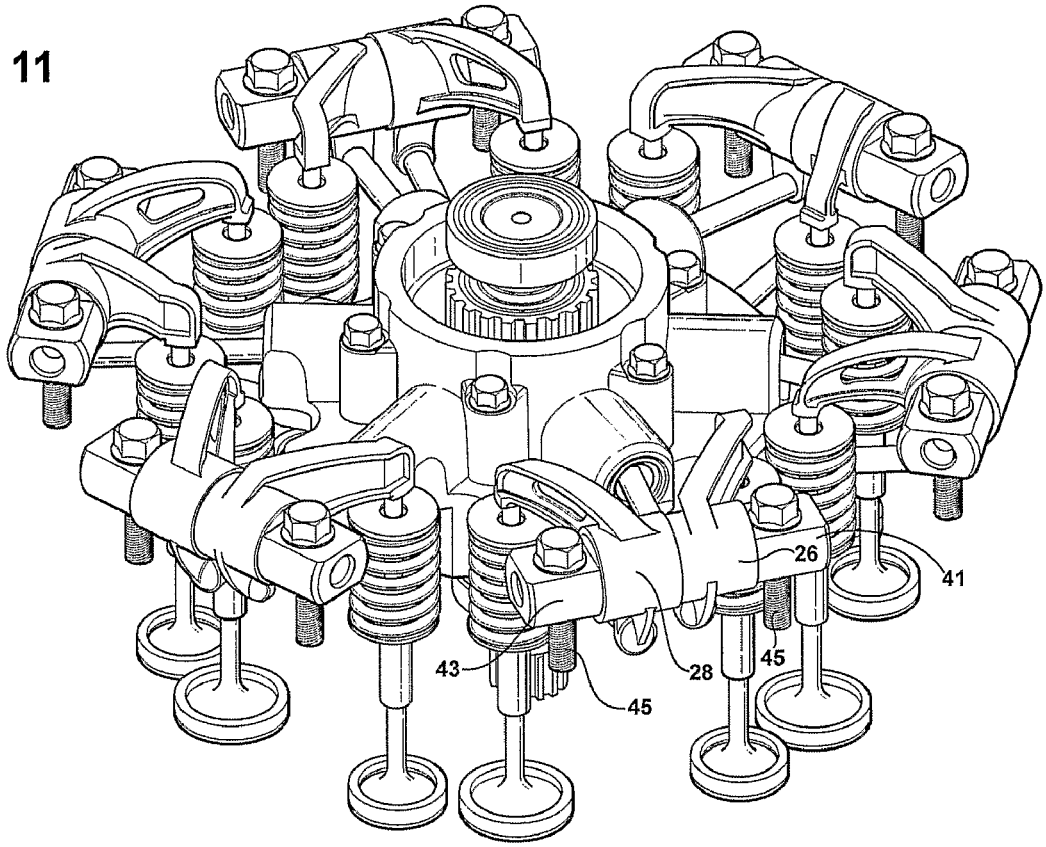
FIG. 11 is a top perspective view of a barrel engine showing the valves and valve actuation mechanism according to a third embodiment of the invention.
Figure 12:
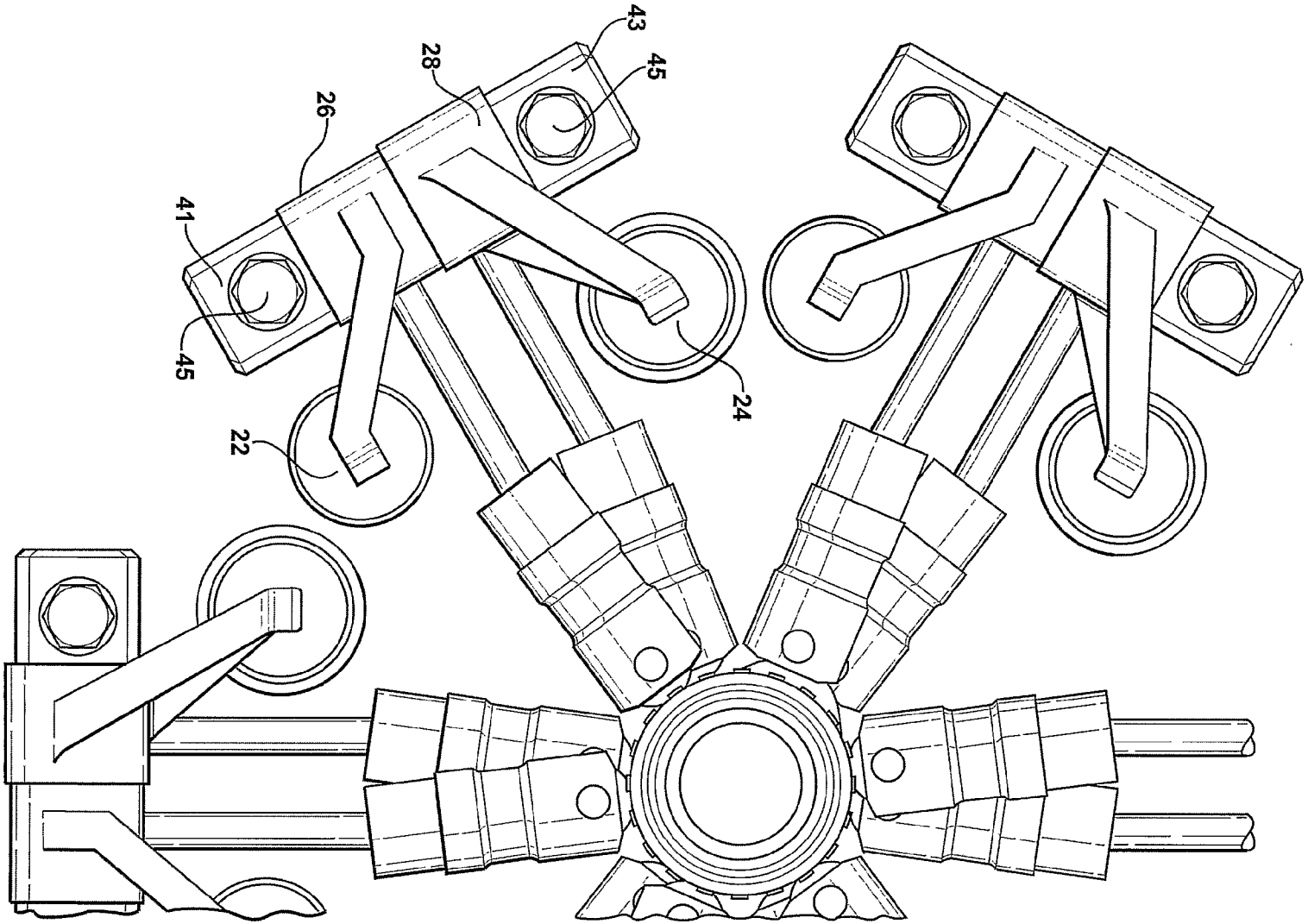
FIG. 12 is a partial top elevational view of the valve actuation mechanism according to the third embodiment of the invention.

Referring to FIGS. 11-12, a third embodiment of a valve actuation mechanism for a barrel-type engine is shown, wherein the rockers 26, 28 are positioned adjacent each other along a single pivot pin (not shown), which simplifies the overall assembly and reduces manufacturing costs relative to the previous embodiments. The main body 39 from the previous embodiments is replaced by a rocker assembly including a spaced apart pair of supports 41, 43. The pivot pin is supported by the supports 41, 43, which are fixedly secured to the engine block (not shown) using bolts 45, or other conventional fasteners or fastening methods. The pivot pin may be generally orthogonal relative to the pushrods, so as to minimize or eliminate axial loading of the rockers 26, 28. Optionally, pressurized oil is fed to the interface between the pivot pin and the rockers 26, 28 via oil paths formed in the supports 41, 43 and the bolts 45 and/or engine block. Like the previous embodiments, the pair of rockers 26, 28 between the supports 41, 43 actuates respective valves 22, 24 of an adjacent pair of cylinders. Also, like the previous embodiments, the rocker assemblies are positioned radially outboard of the cylinders and are arranged in a circle generally concentric with the drive shaft.

Figure 13:
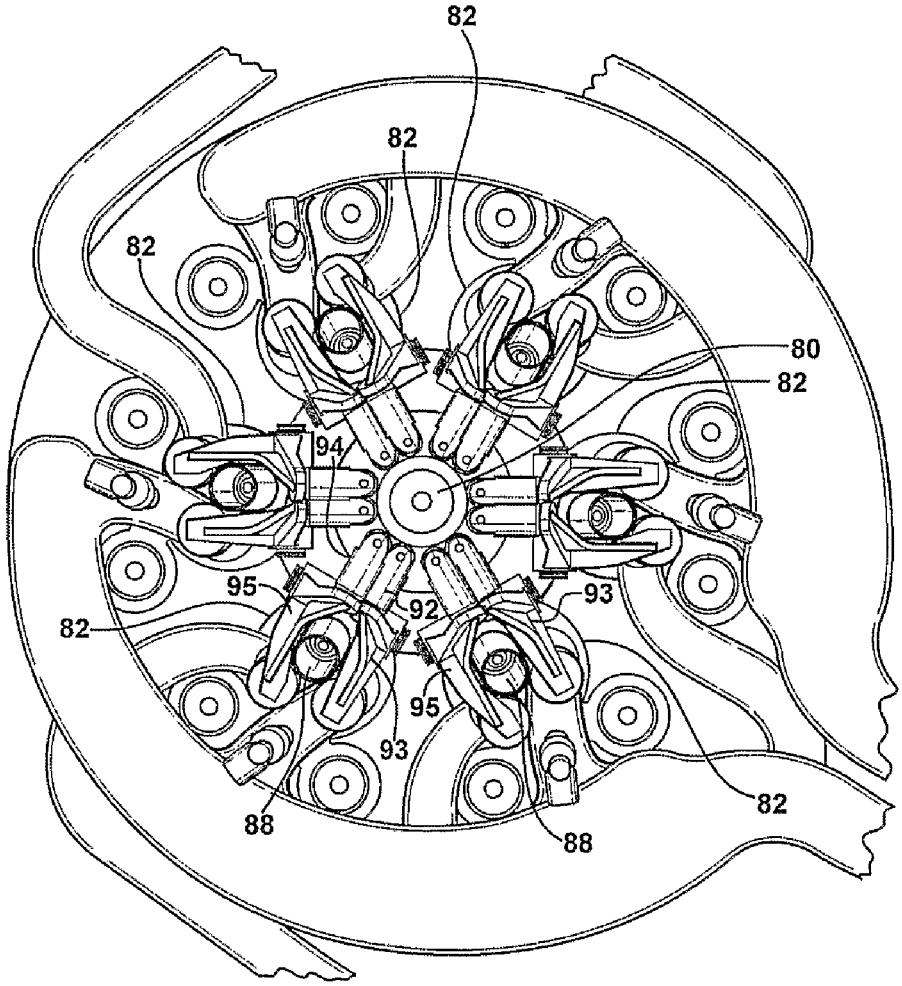
FIG. 13 is a top elevational view of the barrel engine according to a fourth embodiment of the invention.
Figure 14:
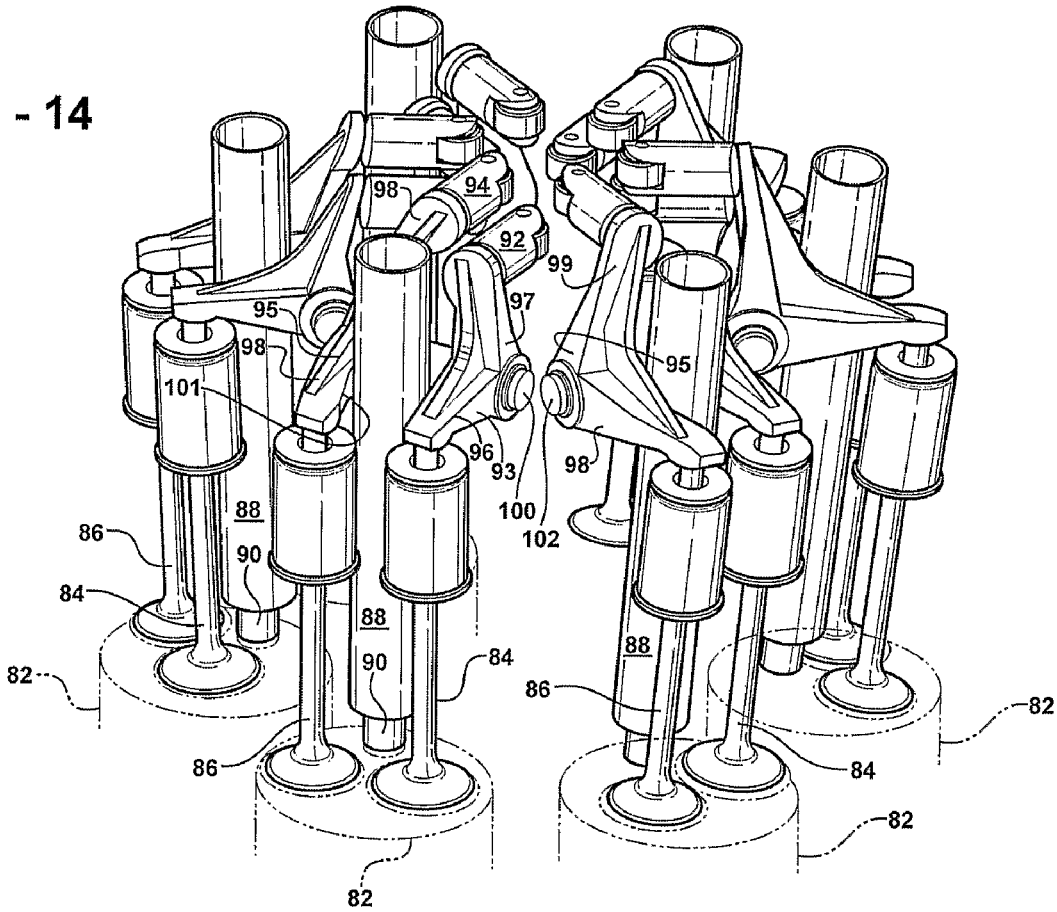
FIG. 14 is a top perspective view of the valve actuation mechanism according to the fourth embodiment of the invention.

Referring now to FIGS. 13-14, a fourth embodiment of a valve actuation mechanism for a barrel-type engine is shown. The drive shaft 80 is shown with cylinders 82 arranged around the power shaft 80 with axes that are generally parallel to the shaft 80. A pair of valves 84, 86 are provided for each cylinder 82. Unlike the previous embodiment, neighboring pairs of tappets 92, 94 actuate valves 84, 86 for the same cylinder 82. The valve actuation mechanism of this embodiment makes use of L-shaped rocker 93, 95 which are supported by pivot pins 100, 102 respectively. Unlike the previous embodiments, the tappets 92, 94 are positioned above the pivot axis defined by the pivot pins 100, 102. First arms 97, 99 of the rockers 93, 95 are directly coupled to the tappets 92, 94 without need for the pushrods of the previous embodiments. The first arms 97, 99 also extend in a direction pointing away from the cylinders, rather than toward the cylinders in the previous embodiments. Additionally, the pivot pins 100, 102 are positioned radially inwardly with respect to the cylinders 82. As such, this design is more compact radially, but is less compact axially relative to the previous embodiments shown in FIGS. 1-12.

In the case of a spark-ignition type barrel engine, a plurality of spark plug tubes may be provided to define paths for accessing the spark plugs in the engine. The spark plug tubes are indicated at 88 in FIGS. 13 and 14. Each spark plug tube 88 extends outwardly through a space defined between adjacent pairs of rockers 93, 95. The second arm 98 of at least one of the rockers 95 includes an inner edge 101 that is concave and extends around the spark plug tube 88 to avoid contact with the spark plug tube 88 during rotation of the rocker 95. It should be appreciated that the inner edges of both rockers 93, 95 may be concave to accommodate the spark plug tube 88. This arrangement also helps to minimize the spacing between adjacent pairs of rockers 93, 95.

In this embodiment, the tappets 92, 94 are generally parallel to each other, but may be configured to extend radially with respect to the rotational axis of the drive shaft 80. The first arms 97, 99 would then be shaped to accommodate the position of the outboard ends of the tappets 92, 94 and the axial displacement of the tappets 92, 94 along their radially-aligned axes.

It should be appreciated by those having ordinary skill in the art that the invention as described herein may be used in a variety of barrel engine types, such spark ignition, diesel, HCCI or any combination thereof. The invention may be used in combination with any of the technologies as disclosed in U.S. Pat. Nos. 6,662,775; 6,899,065; 6,986,342; 6,698,394; 6,834,636, and U.S. patent application Ser. Nos. 10/997,443; 11/255,804; 11/360,779; 60/773,263; 60/721,853; 60/774,982; 60/774,343; 60/774,344; 60/774,982; 60/774,411; 60/773,109; 60/774,410; 60/774,856; 60/773,090; 60/773,936; 60/773,233; 60/773,234, all of which are incorporated herein by reference in their entirety.

It should also be appreciated by those having ordinary skill in the art that the invention as described herein may be be incorporated with an engine having more than two valves per cylinder. The invention may also utilize multiple valves per tappet and/or additional cam lobes.

The invention has been described in an illustrative manner. It is, therefore, to be understood that the terminology used is intended to be in the nature of words of description rather than of limitation. Many modifications and variations of the invention are possible in light of the above teachings. For example, in any of the previous embodiments, the pivot axes of adjacent rockers may be coaxial or noncoaxial. Thus, within the scope of the appended claims, the invention may be practiced other than as specifically described.

I claim:

1. A valve actuation mechanism for a barrel internal combustion engine having a drive shaft with a cam portion, an undulating cam plate interconnected with the drive shaft for rotation therewith, and a plurality of cylinders radially spaced apart from the drive shaft, said valve actuation mechanism comprising:

a plurality of tappets configured to engage the cam portion of the drive shaft;

a plurality of valves each having a valve head and a valve stem extending from the valve head;

a plurality of rockers actuating the valves, the rockers being mechanically coupled to the tappets for actuating the valves in response to rotation of the drive shaft; and a rocker support pivotally supporting a pair of the rockers for movement about respective pivot axes, one of the rockers in the pair actuating a valve associated with one of the cylinders and the other of the rockers in the pair actuating a valve associated with an adjacent cylinder.

2. A valve actuation mechanism as set forth in claim 1, wherein the pivot axes of each of the rockers are spaced radially outwardly relative to the valve actuated by the rocker.

3. A valve actuation mechanism as set forth in claim 1, wherein each rocker includes first and second arms extending outwardly ftom the pivot axis, the first arm being coupled to one of the tappets and the second aim being coupled to one of the valve stems to cause actuation of one of the valves in response to rotation of the drive shaft.

4. A valve actuation mechanism as set forth in claim 3, wherein the second arm extends at an angle between the pivot axis and a longitudinal axis of the one of the tappets.

5. A valve actuation mechanism as set forth in claim 3, including a push rod operatively connecting the second arm and the tappet.

6. A valve actuation mechanism as set forth in claim 1, wherein the pivot axes of the pair of the rockers are generally coaxial.

7. A valve actuation mechanism as set forth in claim 1, wherein a longitudinal axis of each tappet extends radially relative to a rotational axis of the drive shaft.

8. A valve actuation mechanism as set forth in claim 1, wherein the pivot axis of each rocker is generally orthogonal relative to a longitudinal axis of the tappet coupled to the rocker.

9. A valve actuation mechanism as set forth in claim 1, wherein each tappet includes a roller.

10. A valve actuation mechanism as set forth in claim 1, wherein each tappet is hydraulic.

11. A valve actuation mechanism as set forth in claim 1, wherein one of the pair of the rockers actuates an intake valve of one cylinder and the other of the pair of rockers actuates an exhaust valve of an adjacent cylinder.

12. A valve actuation mechanism as set forth in claim 11, wherein a first tappet of one of the plurality of tappets is engaged with the one of the pair of the rockers that actuates the intake valve, a second tappet of one of the plurality of tappets being engaged with the one of the pair of the rockers that actuates the exhaust valve, and wherein the first and second tappets are axially spaced apart for engaging respective lobes of the cam portion.

13. A barrel internal combustion engine comprising:

a longitudinally extending drive shaft rotatable about a center axis, the drive shaft including a cam portion;

a pair of can lobes extending radially outwardly from the cam portion for rotation therewith;

a plurality of cylinders each having an axis generally parallel with the drive shaft;

a plurality of valves controlling the flow of gases through the cylinders, at least two or the plurality of valves associated with each of the plurality of cylinders;

a plurality of tappets engaged with the cam lobes to cause radial displacement of each tappet relative to the center axis during rotation of the drive shaft about the center axis; and a plurality of rockers each moveable about a pivot for actuating the valves, the rockers being arranged in pairs that are adjacent to each other and spaced from other pairs, one of the rockers in each adjacent pair actuating a valve associated with one of the cylinders and the other of the rockers in the pair actuating a valve associated with an adjacent cylinder.

14. A valve actuation mechanism as set forth in claim 13, wherein the plurality of valves includes intake and exhaust valves, the intake valves being actuated by one of the pair of cam lobes, the exhaust valves being actuated by the other of the pair of cam lobes.

15. A barrel internal combustion engine as set forth in claim 13, wherein each rocker has a first arm in mechanical communication with one of the tappets to cause rotation of the rocker about the pivot during rotation of the drive shaft about the center axis and a second arm in mechanical communication with the valve to cause actuation of the valve in response to rotation of the rocker about the pivot, the first arm of each rocker extending from the pivot toward the cylinders.

16. A barrel internal combustion engine as set forth in claim 13, wherein the tappets are hydraulic.

17. A barrel internal combustion engine as set forth in claim 13, wherein one rocker in the pair of the rockers actuates an intake valve and the other of the rockers actuates an exhaust valve.

18. A barrel internal combustion engine as set forth in claim 13, wherein one of the pair of rockers pivots about a first pivot axis and the other of the pair of rockers pivots about a second pivot axis, the first and second pivot axes being coaxially aligned.

19. A barrel internal combustion engine as set forth in claim 13, wherein the engine is a four-stroke engine.

20. A barrel internal combustion engine as set forth in claim 13, wherein each tappet includes a longitudinal axis that extends generally radially with respect to the center axis of the drive shall.

21. A barrel internal combustion engine comprising:

a longitudinally extending drive shaft rotatable about a center axis, the drive shaft including a cam portion;

a pair of cam lobes extending radially outwardly from the cam portion for rotation therewith;

a plurality of cylinders each having an axis generally parallel with the drive shaft;

a plurality of valves controlling the flow of gases through the cylinders;

a plurality of tappets engaged with the cam lobes to cause radial displacement of each tappet relative to the center axis during rotation of the drive shaft about the center axis; and a plurality of rockers each moveable about a pivot for actuating the valves, each rocker having a pair of arms extending outwardly from the pivot, one of the pair of arms being coupled to one of the valves and the other of the pair of arms being coupled to one of the tappets to cause actuation of the valve in response to the radial displacement of the tappet during rotation of the drive shaft, one of the pair of arms of each rocker extending from the pivot toward the cylinders.

22. A barrel internal combustion engine as set forth in claim 21, including a rocker support pivotally supporting a pair of the rockers for movement about the respective pivots.

23. A barrel internal combustion engine as set forth in claim 22, wherein the pair of the rockers actuates the valves of an adjacent pair of cylinders.

24. A barrel internal combustion engine as set forth in claim 22, wherein one of the pair of rockers pivots about a first pivot axis and the other of the pair of rockers pivots about a second pivot axis, the first and second pivot axes being coaxially aligned.

25. A barrel internal combustion engine as set forth in claim 21 including a plurality of rocker supports each supporting a pair of the rockers for movement about the respective pivots, the rocker supports being arranged along a circle generally concentric with the drive shaft.

26. A barrel internal combustion engine as set forth in claim 25, wherein the pair of the rockers actuates the valves of an adjacent pair of cylinders.

* * * * *

UNITED STATES PATENT AND TRADEMARK OFFICE

CERTIFICATE OF CORRECTION

PATENT NO. : 8,079,336 B2
APPLICATION NO. : 11/917147
DATED : December 20, 2011
INVENTOR(S) : Anton Polt It is certified that error appears in the above-identified patent and that said Letters Patent is hereby corrected as shown below:

At Column 6, Line 7, delete “earn”, insert --cam--.

At Column 7, Claim 3, Line 58, delete “ftom”, insert --from--.

At Column 7, Claim 3, Line 59, delete “aim”, insert --arm--.

At Column 8, Claim 14, Line 31, delete “can”, insert --cam--.

At Column 9, Claim 21, Line 11, delete “shall”, insert --shaft--.

Signed and Sealed this
Eighteenth Day of December, 2012

David J. Kappos

David J. Kappos
*Director of the United States Patent and Trademark Office*